United States Patent [19]

Tatomir et al.

[11] Patent Number: 4,812,790

[45] Date of Patent: Mar. 14, 1989

[54] TOOTHED COUPLING IRIS

[75] Inventors: Paul J. Tatomir, Torrance; Martin B. Hammond, Glendora, both of Calif.

[73] Assignee: Hughes Aircraft Company, Los Angeles, Calif.

[21] Appl. No.: 155,906

[22] Filed: Feb. 16, 1988

[51] Int. Cl.[4] ..... H01P 1/208; H01P 5/00

[52] U.S. Cl. ..... 333/212; 333/230; 333/248

[58] Field of Search ..... 333/212, 248, 230, 252, 333/113, 114

[56] References Cited

U.S. PATENT DOCUMENTS

| | | | |
|---|---|---|---|
| 2,932,806 | 4/1960 | Burr, Jr. | 333/252 |
| 3,230,483 | 1/1966 | Kinsey | 333/114 |
| 4,060,779 | 11/1977 | Atia et al. | 333/212 |

*Primary Examiner*—Paul Gensler

*Attorney, Agent, or Firm*—Steven M. Mitchell; Mark J. Meltzer; A. W. Karambelas

[57] ABSTRACT

An iris is located in a common wall separating two microwave enclosures such as waveguides and cavities for coupling electromagnetic power between the two enclosures. The iris is formed of an aperture elongated in one direction to define a longitudinal axis of the aperture with opposed first and second sides parallel to the axis. Portions of the common wall at peripheral regions of the aperture are extended from the first and second sides towards the iris and perpendicularly thereto to form teeth, there being an array of teeth extending from the first side and an array of teeth extending from the second side. The teeth are readily polarized as magnetic dipoles by surface currents induced in the wall by electromagnetic waves for increased coefficient of coupling of electromagnetic field components through the iris.

9 Claims, 1 Drawing Sheet

FIG. 5
FIG. 1
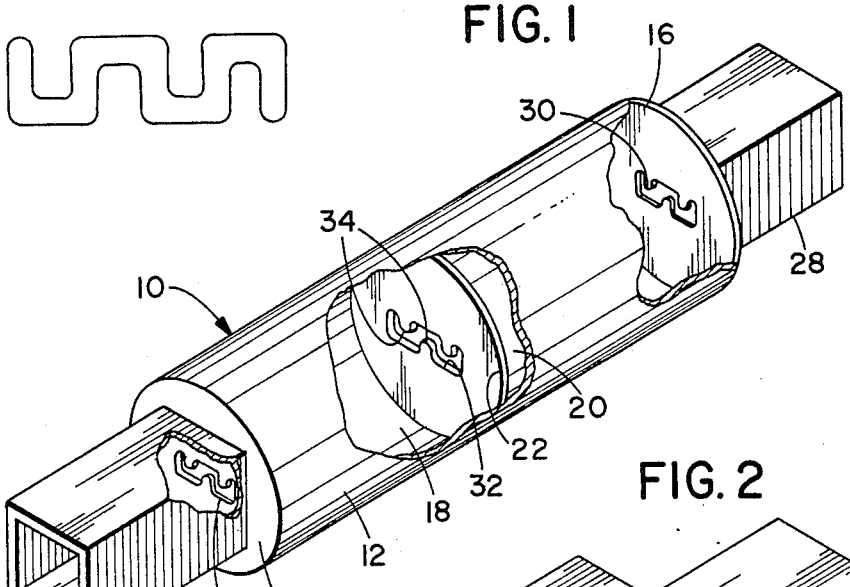
FIG. 2
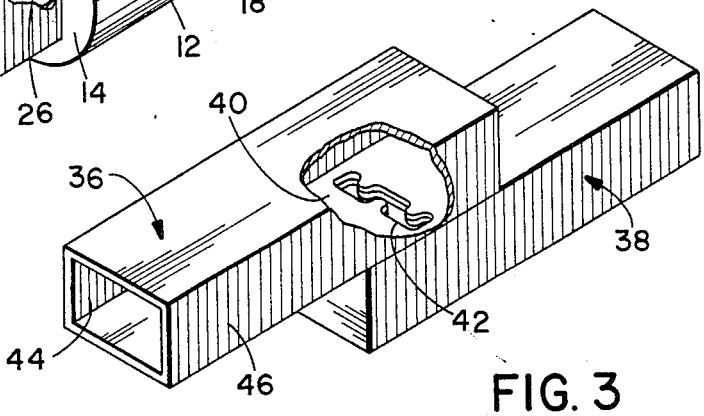
FIG. 3
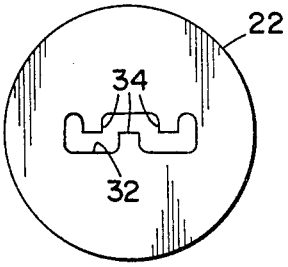
FIG. 4
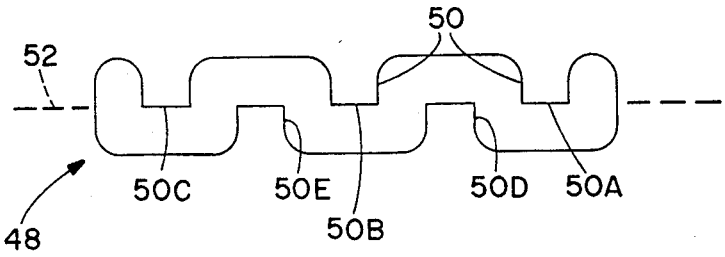

TOOTHED COUPLING IRIS

BACKGROUND OF THE INVENTION

This invention relates to coupling irises employed in the coupling of electromagnetic power through a wall from one microwave structure to another microwave structure and, more particularly, to an iris formed of an aperture having at least one tooth extending inwardly from a periphery of the aperture for increasing magnetic polarizability of the aperture resulting in an increased coefficient of coupling of an electromagnetic field between the two microwave structures.

Microwave structures such as waveguides and the cavities of filters are formed of enclosing walls which contain electromagnetic waves and sustain various modes of vibration of the waves. Such structures may be contiguous with each other with the enclosed regions of the contiguous structures being separated by a common wall. In order to couple electromagnetic power between the two contiguous microwave structures, it is common practice to place a coupling iris in the common wall. The iris may be formed as an elongated aperture in the shape of a slot, or a pair of intersecting slots such as a crossed slot, by way of example. Further examples in the shape of the aperture are a square-shaped aperture and a circular aperture. The shapes and sizes of the apertures are selected to provide a desired magnitude of coupling coefficient, this being the ratio between a coupled field component to the incident field component. The shape,size, and location of the aperture also provides for selectively coupling specific modes of vibration of electromagnetic waves.

A microwave structure of particular interest is a cylindrical resonator in a microwave filter. In such a filter, it is useful to obtain higher order circular modes of propagation of electromagnetic waves, particularly $TE_{121}$ mode. It is desirable to obtain a sufficiently high coupling of electromagnetic .waves into a high Q $TE_{121}$ cylindrical resonator mode for a microwave filter application, the term, Q, being the ratio of energy stored to energy dissipated per cycle.

A problem arises in that available slot shapes of standard coupling irises must be very large to provide the desired high amout of coupling for the $TE_{121}$ mode, as well as for other higher order cavity resonator modes. However, the use of the larger apertures introduces a further problem in that the presence of an overly large aperture in a cavity wall disrupts excessively the electromagnetic fields in the cavity and; furthermore, degrades the cavity Q to an unacceptably low value. As a result, the introduction of an enlarged aperture to provide the increased amount of coupling has defeated the utility of the filter in operating with higher order modes at low loss.

SUMMARY OF THE INVENTION

The foregoing problem is overcome and other advantages are provided, in accordance with the invention, by constructing a coupling iris as an elongated aperture extending in a first direction in a common wall between two microwave structures, and by forming at least a portion of the periphery of the aperture in the form of a tooth which extends into the aperture. In the typical microwave situation wherein a common wall between two microwave structures is fabricated of a metal such as brass or aluminum, the aperture and one or more teeth on the periphery of the aperture are readily formed by a cutting tool driven by a numerically-controlled milling machine to mill in the wall one or more teeth which are directed inwardly towards a central part of the aperture. By placing the iris in a portion of the common wall in which surface currents are induced by electromagnetic waves, the surface currents enter the teeth of the iris to form magnetic dipoles, an effect referred to as magnetic polarizability of the iris. Such magnetic dipoles provide for increased coefficients of coupling of electromagnetic power through the iris. The invention provides that, for a multitooth iris, the coupling is increased by a factor of approximately $2\frac{1}{2}$ times the coupling of a standard slot iris of the same length and width.

BRIEF DESCRIPTION OF THE DRAWING

The aforementioned aspects and other features of the invention are explained in the following description, taken in connection with the accompanying drawing wherein:

FIG. 1 is an isometric view of a two-cavity filter of circular cylindrical construction, portions of the filter being cut away to expose an iris of the invention located in a center wall which separates the two cavities, as well as other slots which may be irises of the invention employed for coupling power into and out of the filter;

FIG. 2 shows two waveguides which are coupled by a toothed iris of the invention, a part of one of the waveguides being cut away to show the iris;

FIG. 3 shows a plan view of the common wall separating the two cavities in FIG. 1, the iris being structured as an aperture having three teeth directed inwardly from the wall towards the central portion of the aperture;

FIG. 4 shows a configuration of an aperture for an iris, in accordance with the invention, wherein there are five teeth extending inwardly towards a central portion of the aperture; and FIG. 5, drawn in the same form as FIG. 4, shows a configuration of an aperture for an iris of the invention wherein the number of upwardly extending teeth is equal to the number of downwardly extending teeth.

DETAILED DESCRIPTION

FIG. 1 shows a filter 10 constructed of a cylindrical sidewall 12 closed off at opposite ends of the filter 10 by a first end wall 14 and a second end wall 16 to define a plurality of cavities arranged in series. To facilitate the description, only two such cavities are shown, by way of example, there being a first cavity 18 and a second cavity 20 which are separated by a common wall 22. A first waveguide 24 having a pair of broad walls and narrow walls arranged in rectangular cross section abuts the first end wall 14 for applying electromagnetic power to the first cavity 18. The power is coupled from the first waveguide 24 to the first cavity 18 by means of an aperture formed as a slot 26 in the first end wall 14, the long dimension of the slot 26 being parallel to a broad wall of the first waveguide 24. A second waveguide 28 of rectangular cross section abuts the second end wall 16 for extracting electromagnetic power from the second cavity 20. The power is coupled from the second cavity 20 to the second waveguide 28 via an aperture configured as a slot 30 in the second end wall 16, the long dimension of the slot 30 being parallel to a broad wall of the second waveguide 28. Both the slots 26 and 30 may be formed in serpentine fashion with teeth, as shown in FIG. 1, or may be formed as straight rectangular slots (not shown).

In accordance with the invention, electromagnetic power is coupled from the first cavity 18 to the second cavity 20 via an iris 32 located in the common wall 22. The iris 32 is formed as an aperture having an overall configuration of a slot which is parallel to both of the slots 26 and 30. The iris 32 is provided with teeth 34 which extend from opposite sides of the slot configuration of the iris 32 inwardly towards a center line of the iris 32. The teeth 34 are formed by extension of the material of the wall 22 towards a center line of the iris 32, which construction of the teeth 34 is readily implemented by use of a cutter in an automated milling machine. The wall 22, as well as the other walls 12, 14, and 16 of the filter 10 are fabricated of electrically conducting material, preferably a metal such as aluminum or brass.

FIG. 2 shows a further example of two microwave enclosures coupled by an iris of the invention. In FIG. 2, a first waveguide 36 is coupled to a second waveguide 38, both of which have rectangular cross section and share a common broad wall 40 at a junction between the two waveguides 36 and 38. The two waveguides 36 and 38 are parallel to each other. An iris 42 is constructed in accordance with the invention and is located on the common broad wall 40 to couple electromagnetic power from the first waveguide 36 to the second waveguide 38. It is noted that in both the microwave assemblies of FIGS. 1 and 2, these assemblies operate reciprocally so that electromagnetic power may flow from the second waveguide 28 (FIG. 1) via the filter 10 to the first waveguide 24 and, similarly, power can flow from the second waveguide 38 (FIG. 2) via the iris 42 to the first waveguide 36. The iris 42 has the same configuration as the iris 32 (FIG. 1) and is oriented perpendicularly to the flow of electromagnetic power in each of the waveguides 36 and 38. The iris 42 may be provided with any desired length, as measured between opposed sidewalls 44 and 46 of the first waveguide 36, a typical length of the iris 42 being approximately one-half the distance between the two sidewalls 44 and 46. While the iris 42 is shown having three teeth, this being the same number of teeth as the iris 32, it is to be understood that additional teeth may be employed, if desired.

FIG. 3 shows an enlarged view of the common wall 22 of FIG. 1 with the aperture 32 disposed in the wall 22. FIG. 3 demonstrates that the iris 32 can be fabricated by use of a rotating cutter in a milling machine wherein the width of the aperture of the iris 32 has a constant value equal to the diameter of such cutter.

FIG. 4 shows a configuration of an iris 48 which is constructed in the same fashion as the iris 32 of FIG. 3, but is modified to provide for five teeth 50, with individual ones of the teeth 50 being further identified as 50A–50E. The iris 48 is in the form of a slot elongated along a central axis 52. The teeth 50 are constructed by extension of peripheral regions of the iris 48, on opposite sides of the axis 52, inwardly towards the axis 52. Each of the teeth 50 have the same width, this width being equal to the width of the sinuous aperture of the iris 48. The iris 48 is provided with the sinuous aperture by use of a circular cutter of a milling machine, as was described with reference to the construction of FIG. 3, in which the cutter is moved along a meander path in two dimensions, both transverse to the axis 52 and parallel to the axis 52, to construct the teeth 50 by removal of material in the path of the cutter. Alternatively, depending on requirements for polarizability of the iris 48, it may be desirable to have a varying width to the sinuous aperture, or to provide an aperture width greater than a tooth width. In addition, teeth of differing width can be provided if desired. FIG. 5 shows an embodiment of the invention which differs from FIG. 4 in that an equal number of teeth extend upward and downward.

It is noted that the construction of FIGS. 3 and 4 is identical, except for the increased number of teeth 50 (FIG. 4) as compared to the number of teeth 34 (FIG. 3). The teeth 50A, 50B and 50C provide an array of three teeth on one side of the axis 52, while the teeth 50D and 50E provide an array of two teeth on the opposite side of the axis 52. The tooth 50D is interleaved between the teeth 50A and 50B, and the tooth 50E is interleaved between the teeth 50B and 50C. The teeth 50 are parallel to each other and perpendicular to the axis 52. FIG. 3 shows a typical installation of the iris 32 in the wall 22, this installation providing for a centering of the iris 32 within the wall 22. The length and location of the iris 32 is selected in accordance with the specific modes of electromagnetic waves to be coupled through the iris 32.

In operation, the iris 32 is located at a portion of the wall 22 wherein electromagnetic waves induce surface currents which flow in a direction transverse to a longitudinal axis of the iris 32 so as to flow directly in the teeth 34. In response to alternating current induced in each of the teeth 34, magnetic fields are induced which circulate in a circular manner about corresponding ones of the teeth 34 to produce magnetic dipoles at each of the teeth 34. It is anticipated that the invention can be used in conjunction with higher order cavity modes to achieve a resonator Q of 19,000, rather than of Q of 12,000 which is achieved currently with lower order modes and conventional iris slots. The irises 32 and 48 can be used for coupling both higher and lower modes of electromagnetic waves. The multitooth iris can replace a conventional iris of arbitrary shape where adequate coupling is difficult to achieve. In addition, for high Q resonator mode applications, the multitooth iris retains the high Q property. Thus, lower loss microwave cavity resonator filters than has been available heretofore are realizable.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A microwave circuit having a plurality of enclosures configured for sustaining electromagnetic waves, said circuit comprising:

a wall separating two of said enclosures; and an iris disposed in said wall, said iris being formed as an elongated aperture extending in a first direction along said wall to define a first long side and a second long side opposite said first long side; and wherein at least a portion of said wall is configured as a plurality of teeth directed into said aperture and arranged in two arrays, one of said two arrays being located on said first side and the second of said two arrays being located on said second side of said aperture, said first array having one more tooth than said second array; and said teeth forming a part of a periphery of the iris, the teeth introducing increased coupling of electromagnetic power via said iris through said wall.

2. A microwave circuit according to claim 1 wherein said teeth are parallel.

3. A microwave circuit according to claim 1 wherein said aperture has a serpentine form with a width equal to the width of one of said teeth.

4. A microwave circuit according to claim 1 wherein said aperture is elongated in said first direction and extends a distance equal to approximately one-half the corresponding dimension of said wall.

5. A microwave circuit according to claim 4 wherein each of said enclosures is a circular cylinder defining a cavity, said wall having a circular periphery, and said iris being located in the center of said wall.

6. A microwave circuit according to claim 4 wherein each of said enclosures is a rectangular waveguide, said wall being a common sidewall between said two waveguides, said iris being centered between sidewalls of each of said waveguides, said first direction being perpendicular to a direction of propagation of electromagnetic power in one of said waveguides.

7. An iris for coupling electromagnetic power through a common wall of two microwave enclosures, said iris being located in said wall; and wherein said iris is formed as an aperture extending in a first direction along said wall; and wherein at least a portion of said wall is configured as a plurality of teeth having parallel sides directed into said aperture, said teeth being disposed in a first array along a first peripheral portion of said iris and in a second array disposed along a disposed along a second peripheral portion of said iris, the teeth of said first array facing the teeth of said second array, the teeth introducing increased coupling of electromagnetic power via said iris through said wall.

8. An iris according to claim 7 wherein said aperture has a sinuous form with a width equal to the width of one of said teeth, all of said teeth having the same width.

9. An iris according to claim 8 wherein the teeth of said first array are interleaved with the teeth of said second array.

* * * * *